US005330310A

United States Patent [19]

Lin

[11] Patent Number: 5,330,310

[45] Date of Patent: Jul. 19, 1994

[54] DOUBLE-DECK PARKING DEVICE

[76] Inventor: Hyh-Cheeng Lin, 5F, No. 3-1, Lane 49, An Tay Street, Nei Hu, Taipei, Taiwan

[21] Appl. No.: 58,841

[22] Filed: May 10, 1993

Related U.S. Application Data

[63] Continuation-in-part of Ser. No. 776,169, Oct. 15, 1991, abandoned.

[51] Int. Cl.[5] ..... E04H 6/06

[52] U.S. Cl. ..... 414/228; 414/639; 187/8.71

[58] Field of Search ..... 414/227-229, 414/233-234, 639, 743; 254/3 R, 3 C, 45, 89; 187/8.41, 8.71

[56] References Cited

U.S. PATENT DOCUMENTS

| | | | |
|---|---|---|---|
| 2,660,320 | 11/1953 | uallschleger | 414/233 X |
| 3,491,257 | 3/1976 | Matsuura | 414/228 |
| 4,772,172 | 9/1988 | Rosen | 414/228 X |

FOREIGN PATENT DOCUMENTS

| | | |
|---|---|---|
| 1965142 | 7/1971 | Fed. Rep. of Germany . |
| 2644022 | 4/1978 | Fed. Rep. of Germany . |
| 0318667 | 12/1989 | Japan . |
| 0013664 | 1/1990 | Japan . |
| 0027067 | 1/1990 | Japan . |
| 0058675 | 2/1990 | Japan . |
| 0112568 | 4/1990 | Japan . |
| 0153175 | 6/1990 | Japan . |
| 1149609 | 4/1969 | United Kingdom . |
| 2243600 | 11/1991 | United Kingdom . |

OTHER PUBLICATIONS

Park Master Brochure, 2 pages.
Space Maker Brochure, 2 pages.
DuoPark Brochure, 3 pages.

*Primary Examiner*—David A. Bucci
*Assistant Examiner*—James W. Keenan
*Attorney, Agent, or Firm*—Morton J. Rosenberg; David I. Klein

[57] ABSTRACT

A double-deck parking device is provided for parking two cars one above the other in order to more efficiently utilize available parking space. The parking device includes a platform which may be moved to a position adjacent a base plate for locating a vehicle thereon. The platform may be raised above the base plate and another vehicle may be parked on the base plate. The platform may be further raised to a vertical position to allow vehicles of differing heights to be mounted on the base plate thus accommodating differing vehicle heights.

5 Claims, 3 Drawing Sheets

DOUBLE-DECK PARKING DEVICE

REFERENCE TO RELATED PATENT APPLICATION

This patent application is a continuation-in-part of U.S. patent application Ser. No. 07/776,169, filed on Oct. 15, 1991, now abandoned.

BACKGROUND OF THE INVENTION

1. Field of the Invention

The subject invention pertains to parking devices for optimizing the space associated with double-deck parking systems. In particular, this invention pertains to a double-deck parking device for parking two cars in associated parking spaces with one car or vehicle disposed above the other. More in particular, this invention relates to a double-deck parking system which provides for a pair of lifting arm assemblies which are mounted on a base plate and to a pair of support plates which are mounted on opposing longitudinal ends of the base plate. Still further, this invention relates to a double-deck parking system where pivoted arm assemblies are mounted to respective support plates and allow for transverse vertical motion of a platform 6 upon which a vehicle is mounted. Further, this invention system pertains to a double-deck parking device where a vehicle support platform may be moved to a vertical direction to allow varying heights of vehicles mounted on a base plate. Additionally, the subject invention pertains to a double-deck parking system which includes a base plate for parking an initial or first car, a four-bar link mechanism which includes a pair of supports, a pair of lifting arm assemblies and a connecting frame mounted on the base plate on one end thereof. Still further, this invention relates to a double-deck parking system where a driving mechanism is fastened in a pivoting operational mode between two supports to alternatively rotate the four-bar link mechanism reversibly in a forward or rearward direction permitting a platform to be lowered to the ground for parking a vehicle or to be elevated and positioned at a parking positional location above a base plate.

2. Prior Art

Double-deck parking systems are known in the art. The best prior art known to Applicant is German Patent No. 1965142; German Patent No. 2644022; Japanese Patent Publication No. 63-207747; Great Britain Patent No. 1149609; Japanese Patent Publication No. 63-266958; Japanese Patent Publication No. 63-307551; Japanese Patent Publication No. 63-162041; Japanese Patent Publication No. 63-153304; Japanese Patent Publication No. 63-177695; Great Britain Patent No. 2243600; U.S. Pat. Nos. 4,772,172; 3,941,257; and, U.S. Pat. No. 2,660,320, all of which were cited in the Parent case of this Patent Application.

In some prior art systems such as that shown in Patent No. DE1965142, there are provided linkage mechanisms which allow for the mounting of an upper vehicle on the platform however, by necessity of the construction, the height of the vehicle is restricted in that the particular combination of elements of such prior art only allows for the mounting of the vehicle between a main platform and an upper bar section.

SUMMARY OF THE INVENTION

A double-deck parking device is provided which includes a substantially rectangularly contoured base plate having a pair of opposing longitudinally extending end sections and a pair of opposing transversely extending end sections. A pair of longitudinally spaced apart support members are fixedly coupled to the base plate at a respective longitudinal end section adjacent one of the transversely extending end sections. A pair of lifting arm assemblies are respectively coupled in pivotal relation to each of the support member. Each of the lifting arm assemblies include a front arm member and a rear arm member pivotally connected to a respective support member on a first end of each of the front and rear arm members. A lifting arm member is pivotally coupled to the front and rear arm members at a second end. A connecting frame extends in the longitudinal direction and is coupled to the longitudinally displaced opposing front arm members with each of the support members, front and rear arm members and lifting arm members defining a four-bar linkage. A pair of drive mechanisms are provided for rotatively displacing each of the lifting arm assemblies with respect to a respective support member. Each of the drive mechanisms includes a screw rod having an upper end secured to the connecting frame. A hydraulic cylinder is coupled to the screw rod for actuation of the screw rod with the hydraulic cylinder being secured to a respective rear arm member and driven by a reversible motor. A platform is supported on the connecting frame with the platform having substantially the same rectangular contour as the base plate whereby actuation of the drive mechanisms provides for displacement of the platform to a plurality of positions with one position being above the base plate for providing a parking base for a vehicle above the base plate as well as to another position transversely adjacent the base plate for loading a vehicle onto the base plate and also to a position where the platform extends substantially in a vertical direction to allow vehicles of varying height to be mounted on the base plate.

DESCRIPTION OF THE PREFERRED EMBODIMENTS

Figure 1:
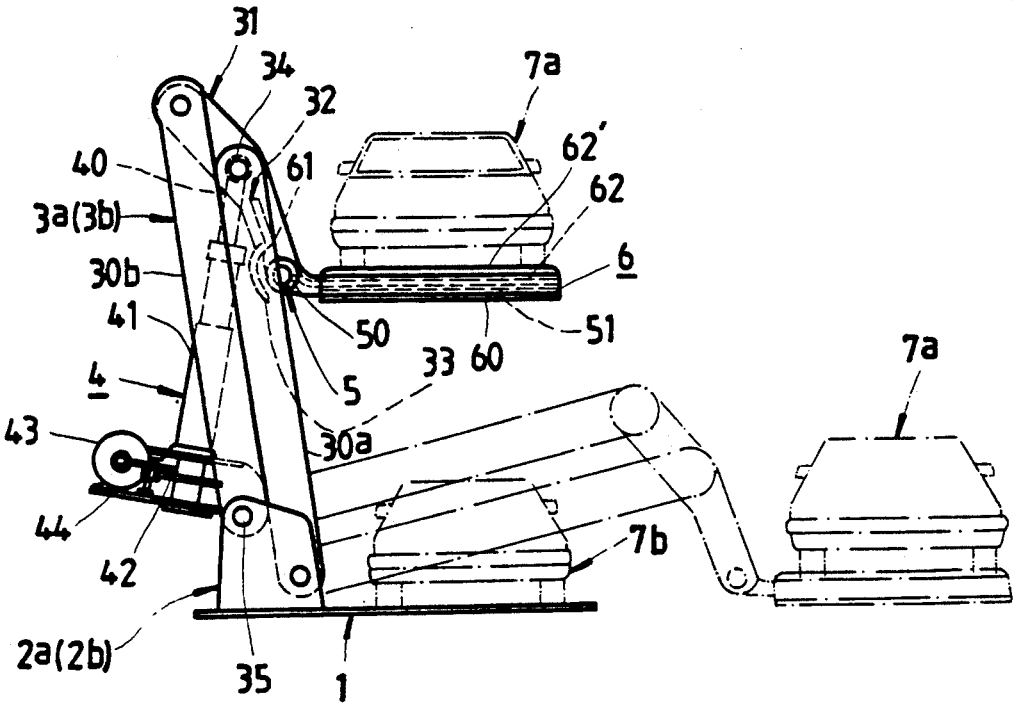
FIG. 1 is an elevational side view of a double-deck parking device embodying the subject invention concept.
Figure 2:
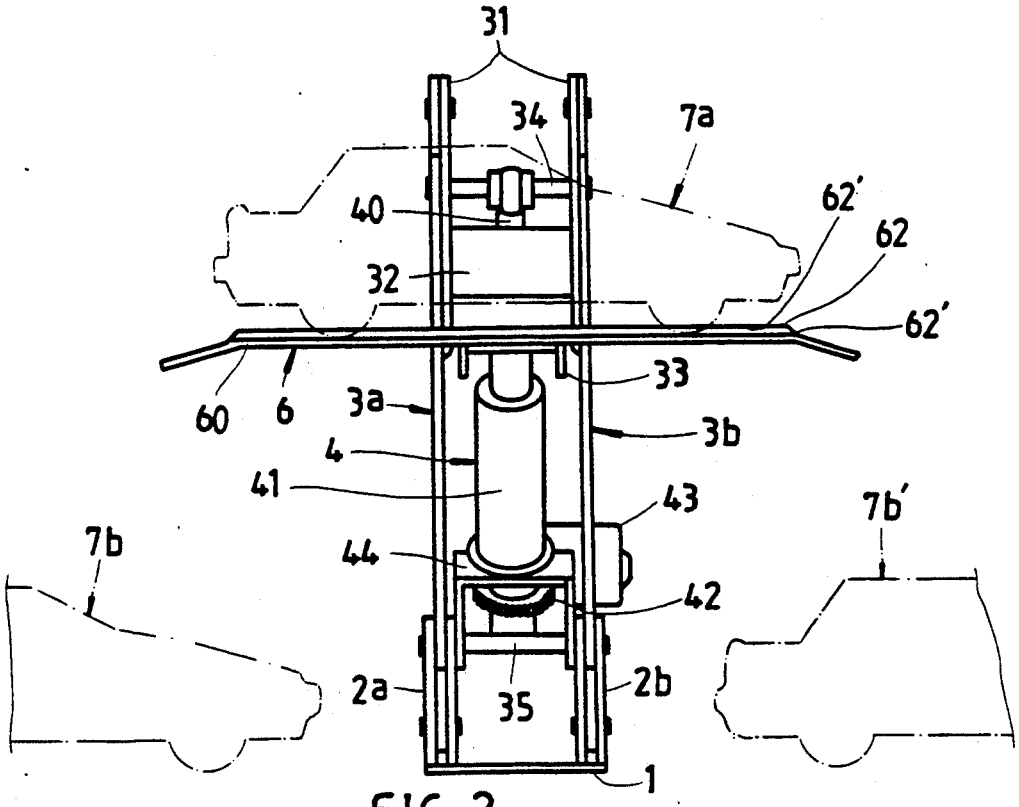
FIG. 2 is a front elevational view of the subject double-deck parking device.

Referring now to FIGS. 1 and 2, there is shown a double-deck parking device constructed in accordance with the present invention concept and is generally composed of a base plate 1, a pair of supports 2*a*, 2*b*, a pair of lifting arm assemblies 3*a*, 3*b*, a driving mechanism 4 in combination with a lift rod assembly 5 and a platform 6.

The base plate 1 is a generally flat or planar plate member of predetermined thickness formed of a metal composition not important to the inventive concept as herein described with the exception that such be able to accept the loads of vehicles 7*b* mounted thereon. The two supports 2*a*, 2*b* are longitudinally spaced apart and are fixedly coupled to the base plate 1 at respective longitudinal end sections adjacent one of the transversely extending end sections of the base plate 1. The base plate 1 being planar in contour has a pair of opposing longitudinally extending end sections as well as a pair of opposing transversely extending end sections.

The pair of lifting arm assemblies 3*a*, 3*b* are respectively pivoted in relation to support members 2*a*, 2*b*. Each of the lifting arm assemblies 3*a* and 3*b* includes a frontally pivoted arm 30*a*, a rear pivoted arm 30*b*, a lifting arm 31 and a connecting frame 32. The front pivoted arm 30*a* and rear pivoted arm 30*b* of each lifting arm assembly 3*a* and 3*b* respectively are pivoted to either of the support members 2*a* or 2*b* and are inclined in a rearward direction through an approximate angle range of 5°–10°. In this manner, the front pivoted arm member 30*a* is located frontally of the rear pivoted arm member 30*b*.

The connecting frame 32 is coupled between the two front pivoted arm members 30*a* of the lifting arm assemblies 3*a* and 3*b* at an upper location in order that the two lifting arm assemblies 3*a*, 3*b* may be simultaneously rotated forwardly to a horizontal position by means of the operation of the driving mechanism 4.

The lifting arm 31 is formed from a substantially angle-shaped bar member. The rear end and a middle portion of the lifting arm 31 are respectively pivoted to the front and rear pivoted arms 30*a*, 30*b* at an upper location.

In this manner, the lifting arm assembly 3*a*, 3*b* and the support members 2*a*, 2*b* are formed or incorporated into a four-bar linkage mechanism which permits the platform 6 to be constantly maintained in a horizontal position during the rotation of the front and rear pivoted arms 30*a*, 30*b*. Additionally, as is clearly seen in FIG. 3, platform 6 may be further rotated to a positional location which extends substantially in a vertical direction to allow differing vehicle heights to be mounted on base plate 1.

The driving mechanism 4 includes a screw rod 40, a cylinder 41, a speed reducing gear 42, a reversible motor 43 and a mount 44. The screw rod 40 has an upper end secured to the pivot 34 which is fastened between the two front pivoted arms 30*a* of the pair of lifting arm assemblies 3*a*, 3*b*. The hydraulic cylinder 41 is mounted on the screw rod 40 through a screw joint. The mount 44 is mounted on the pivot shaft 35 which is fastened between the pair of rear pivoted arms 30*b* of the pair of lifting arm assemblies 3*a*, 3*b* and the pair of supports 2*a*, 2*b* for holding the speed reducing gear 42 and the reversible motor 43 which permits the output shaft of the speed reducing gear 42 to be coupled to the cylinder 41 at a bottom or lower location.

Initiation and actuation of the reversible motor 43 will cause the cylinder 41 to be rotated through the speed reducing gear 42. Rotation of the cylinder 41 causes the screw rod 40 to move in a reversible upward or downward direction.

Therefore, the pair of lifting arms 31 and the lifting arm assemblies 3*a*, 3*b* are then simultaneously displaced or moved to rotate in a forward or rearward direction. The lift rod assembly 5 includes a hollow rod 50 connected between the pair of lifting arms 31 of the two lifting arm assemblies 3*a*, 3*b* at a frontal location and a plurality of bearing rods 51 connected to the hollow rod 50 orthogonally or at right angles to hold the platform 6 which may be fastened to the bearing rods 51 through a welding joint or some other like fastening mechanism.

Figure 3:
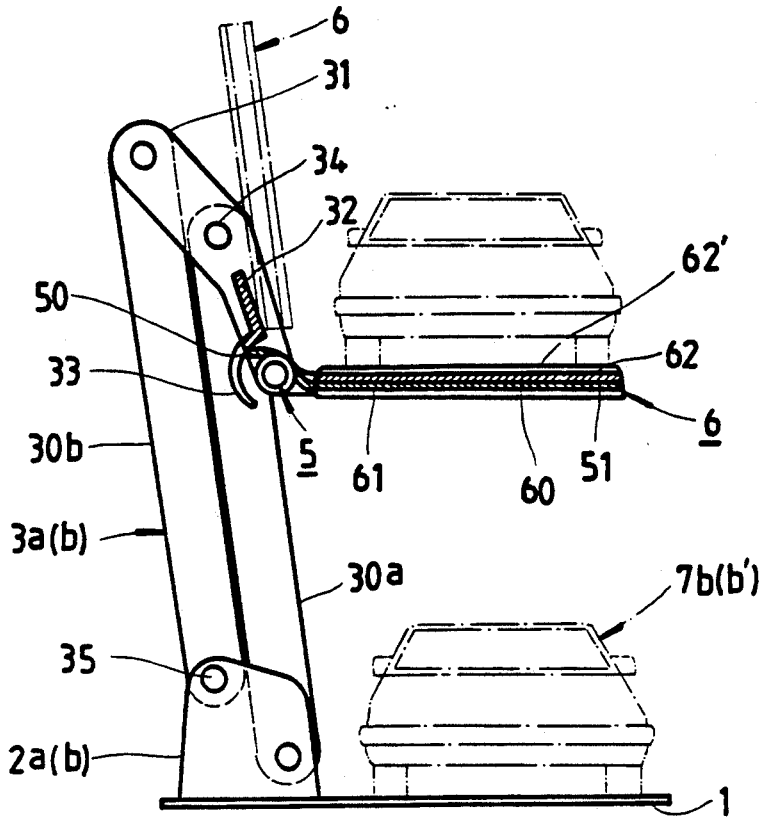
FIG. 3 is an elevational side sectional view of the double-deck parking device.

The platform 6 is formed from a rectangularly contoured planar plate 60 having a pair of sloping edges at opposite ends so that a vehicle may be easily displaced therein. A locating plate 61 is welded or otherwise fastened to the plate 60 at a bottom section and a plurality of longitudinal ribs 62 and transversely extending ribs 62' are formed at an upper section. When the platform 6 is attached to the bearing rods 51, the terminal end of the locating plate 61 is contiguous the bottom of the connecting frame 32 and thus the platform 6 may be constantly maintained in a horizontal position as shown in FIG. 3. Additionally, due to the arrangement of the ribs 62, 62', the vehicle 7*a* which is located on the platform 6 may be firmly maintained in its positional location. Additionally, a further rotation of the platform 6 may be provided to a position where the platform 6 essentially extends in a vertical direction as shown in FIG. 3.

During installation, the base plate member 1 is fastened to a base surface or the ground on one side and defines a unit parking area having two parking spaces available one above the other. The reversible motor 43 is coupled to a power supply through a control device which has a change-over switch for controlling the reversible motor 43 to allow rotation in opposing directions and a fail-safe switch to automatically cut off the power supply which is well known in the art and not within the scope of the subject invention concept. When the change-over switch is initiated to a "forward" position, the driving mechanism 4 is initiated to lower the two lifting arm assemblies 3*a*, 3*b* and the platform 6 which permits the platform 6 to be placed or located on the ground at an opposite side of the parking area as shown by the phantom line drawing in FIG. 1. Subsequent to the mounting or parking of a car 7*a* on the platform 6, the change-over switch is then initiated to a "backward" position which causes the reversible motor 43 to rotate in a reverse direction so that the platform 6 as well as the car 7*a* may be displaced or moved in a backward manner and disposed at a position above the base plate member 1 as shown in FIGS. 3 and 4.

Figure 4:
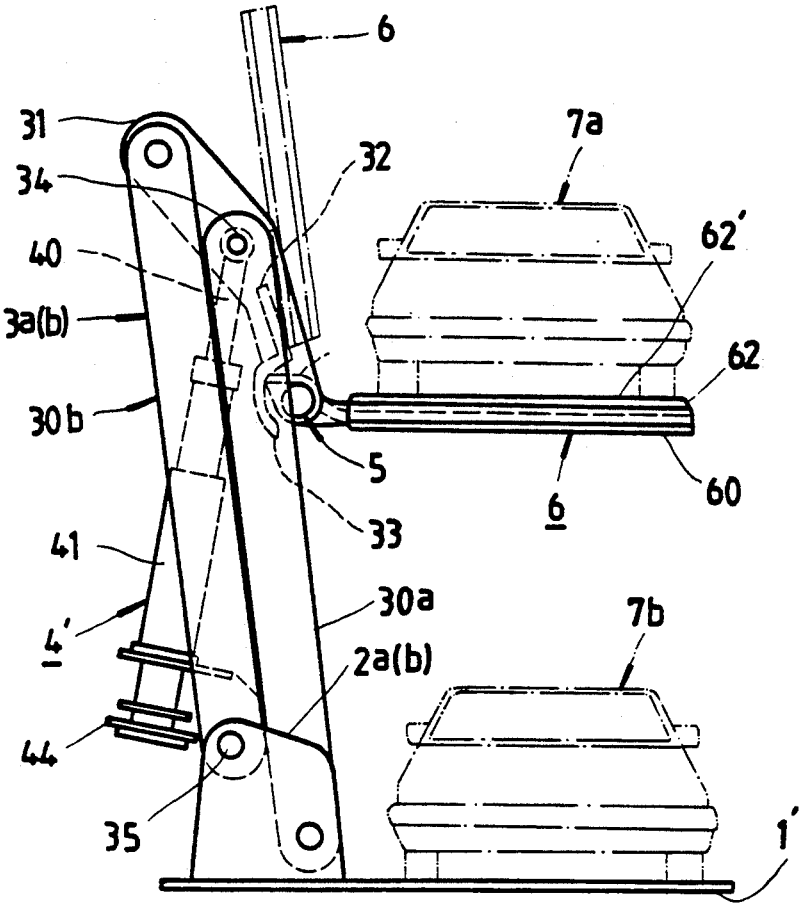
FIG. 4 is a side elevational view of an embodiment of an embodiment of the subject double-deck parking device; and, FIG. 5 is a front elevational view of the embodiment of the double-deck parking device shown in FIG. 4.
Figure 5:
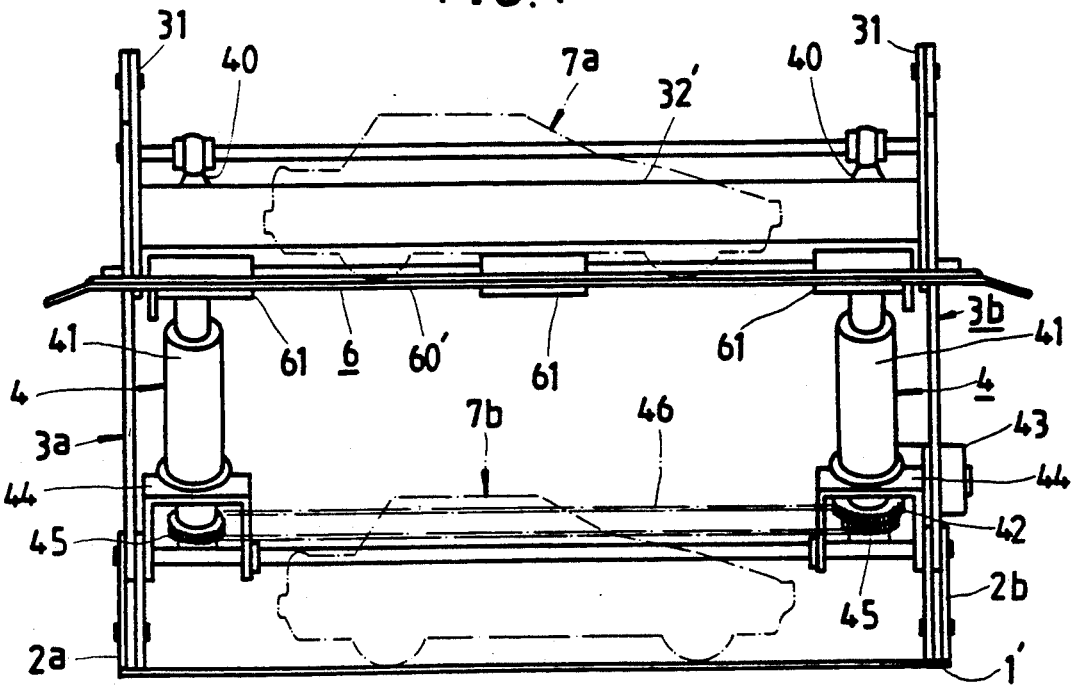

Referring to FIGS. 4 and 5, there is provided an alternate form of the subject invention concept. In the embodiment shown in FIGS. 4 and 5, the numerals which are the same as that in the preferred embodiment of the present invention designate the same parts or mechanisms. The alternate or embodiment of the double-deck parking device includes a base plate 1' which is as long as the length of a unit parking area as previously defined. There is further included a pair of supports 2*a*, 2*b* mounted on the base plate 1' on one side at opposing ends. A pair of lifting arm assemblies 3*a*, 3*b* are respectively secured to the supports 2*a*, 2*b* and a driving mechanism 4 as well as an auxiliary driving mechanism 4' are respectively mounted on the pivot shaft 35 which secures the pair of lifting arm assemblies 3*a*, 3*b* to the pair of supports 2*a*, 2*b*. As in the previous case a platform member 6 is provided. The auxiliary driving mechanism 4' includes a screw rod 40, a cylinder 41 and a mount 44 and is coupled to the driving mechanism 4 by a pair of chain wheels 45, 45' and a chain 46.

Thus, the auxiliary driving mechanism 4' may be synchronously operated with the driving mechanism 4. In another example of the present invention concept, a gear transmission mechanism which includes a bevel gears with a transmission shaft connected therebetween may be used for coupling the driving mechanism and the auxiliary driving mechanism for synchronous motion. In this embodiment, at least a pair of locating plates 61 are used so as to firmly support and carry the platform 6. Further, a pair of locating spring plates 33 may be attached to the connecting frame 32 or 32' as shown in the embodiment at opposing ends as shown in FIGS. 3 and 4 by which the platform 6 may be supported in a vertical position when it is not in use or when a vehicle of extended weight is mounted on the base plate 1.

What is claimed is:

1. A double-deck parking device comprising:

(a) a substantially rectangular base plate having a pair of opposing longitudinally extending end sections and a pair of opposing transversely extending end sections;

(b) a pair of longitudinally spaced apart support members, each of said support members fixedly coupled to said base plate at a respective longitudinal end section adjacent one of said transversely extending end sections;

(c) a pair of lifting arm assemblies respectively coupled in pivotal relation to each of said support members, each of said lifting arm assemblies including a front arm member and a rear arm member pivotally connected to a respective support member on a first end of each of said front and rear arm members, a lifting arm member pivotally coupled to said front and rear arm members at a second end thereof, and a connecting frame extending in said longitudinal direction coupled to said longitudinally displaced opposing front arm members, each of said support members, front and rear arm members and lifting arm members defining a four bar linkage;

(d) a pair of drive mechanisms for rotatively displacing each of said lifting arm assemblies with respect to a respective support member, each of said drive mechanisms including a screw rod having an upper end secured to said connecting frame, a hydraulic cylinder coupled to said screw rod for actuation thereof, said hydraulic cylinder being secured to a respective rear arm member and driven by a reversible motor;

(e) a platform supported on said connecting frame, said platform having substantially the same rectangular contour as said base plate, wherein actuation of said drive mechanisms provides for displacement of said platform (1) to a position above said base plate for providing a parking base for a vehicle above said base plate; (2) to a position transversely adjacent said base plate for loading a vehicle thereon, and (3) to a position wherein said platform extends substantially in a vertical direction to allow vehicles of varying height to be mounted on said base plate.

2. The parking device of claim 1, which further comprises an auxiliary driving mechanism coupled to each of said driving mechanisms for synchronous motion therebetween in moving said platform, said auxiliary driving mechanism being comprised of a screw rod having a top end secured to said connecting frame and a bottom end secured to a mount fastened between said two rear arm members of said two lifting arm assemblies and said two support members, and a cylinder mounted on said screw rod thereof through a screw joint.

3. The parking device of claim 1, wherein said connecting frame includes a pair of locating spring plates secured thereto at opposing ends for supporting said platform in a vertical position.

4. The parking device of claim 2, wherein said auxiliary driving mechanism is coupled to said driving mechanism through a chain transmission mechanism which includes a pair of chain wheels with a chain member mounted thereon.

5. The parking device of claim 2, wherein said auxiliary driving mechanism is coupled to said driving mechanism through a gear transmission mechanism which includes a pair of bevel gears having a transmission shaft connected therebetween.

* * * * *